US008439462B2

(12) United States Patent
Seo et al.

(10) Patent No.: US 8,439,462 B2
(45) Date of Patent: May 14, 2013

(54) REFRIGERATOR

(75) Inventors: Woon Kyu Seo, Gyeongsangnam-do (KR); Jung Yeon Hwang, Gyeongsangnam-do (KR); Han Jin Jung, Gyeongsangnam-do (KR); Hyeon Jin Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 426 days.

(21) Appl. No.: 12/707,187

(22) Filed: Feb. 17, 2010

(65) Prior Publication Data

US 2010/0326122 A1 Dec. 30, 2010

(30) Foreign Application Priority Data

Jun. 24, 2009 (KR) ..... 10-2009-0056470

(51) Int. Cl.
*A47B 96/16* (2006.01)

(52) U.S. Cl.
USPC ..... 312/405.1; 312/321.5; 62/377

(58) Field of Classification Search ..... 312/401, 312/405, 405.1, 408, 321.5, 351; 62/377, 62/382
See application file for complete search history.

(56) References Cited

U.S. PATENT DOCUMENTS

| | | | | | |
|---|---|---|---|---|---|
| 2,749,718 | A | * | 6/1956 | Saunders | 62/377 |
| 2,784,044 | A | * | 3/1957 | Kurowski | 312/405.1 |
| 2,852,328 | A | * | 9/1958 | Jewell et al. | 312/405.1 |
| 3,469,711 | A | * | 9/1969 | Swaneck et al. | 312/351 |
| 4,801,182 | A | * | 1/1989 | Metcalfe et al. | 312/321.5 |
| 5,346,299 | A | * | 9/1994 | Werkmeister et al. | 312/405.1 |
| 5,375,924 | A | * | 12/1994 | Pohl et al. | 312/405.1 |
| 2005/0204966 | A1 | | 9/2005 | Bienick et al. | |

FOREIGN PATENT DOCUMENTS

| | | | |
|---|---|---|---|
| CN | 1952564 | A | 4/2007 |
| GB | 2176885 | * | 1/1987 |
| JP | 04-045382 | A | 2/1992 |
| JP | 2006-141797 | A | 6/2006 |
| WO | WO 2009/071342 | A1 | 6/2009 |
| WO | WO 2009/081249 | A1 | 7/2009 |

OTHER PUBLICATIONS

European Search Report dated Apr. 1, 2011 for Application No. EP10160310, 6 pages.
Chinese Office Action dated Nov. 23, 2011 for Application No. 201010124926.3, with English Translation, 15 pages.

* cited by examiner

*Primary Examiner* — James O Hansen
(74) *Attorney, Agent, or Firm* — Fish & Richardson P.C.

(57) ABSTRACT

The embodiment relates to a refrigerator. The refrigerator according to one embodiment includes: a cabinet in which a storage chamber is formed; a door that is connected to the cabinet and opens and closes the storage chamber; a receiving member that is mounted in the door and receives foods; a guide unit that guides an up and down movement of the receiving member in a state where the receiving member is mounted in the door; and a fixing unit that fixes a position at which the receiving member is moved.

19 Claims, 9 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2009-0056470 (filed on Jun. 24, 2009), which is hereby incorporated by reference in its entirety.

BACKGROUND OF THE INVENTION

The embodiment relates to a refrigerator.

Generally, a refrigerator is a device for storing foods, which are stored in a storage chamber, at a low temperature state.

The refrigerator includes a main body in which a storage chamber is formed and a door that is connected to the main body and opens and closes the storage chamber.

The rear surface of the main body or the door is provided with a receiving member that can receive foods. The receiving member is separately connected to the main body or the door, such that the position of the receiving member can be controlled according to a size of foods.

SUMMARY OF THE INVENTION

The embodiments propose a refrigerator.

A refrigerator according to one aspect of embodiments includes: a cabinet in which a storage chamber is formed; a door that is connected to the cabinet and opens and closes the storage chamber; a receiving member that is mounted in the door and receives foods; a guide unit that guides an up and down movement of the receiving member in a state where the receiving member is mounted in the door; and a fixing unit that fixes a position at which the receiving member is moved.

A refrigerator according to another aspect of embodiments includes: a cabinet in which storage chamber is formed; a door that is connected to the cabinet and opens and closes the storage chamber; a mounting part that is positioned at a rear surface of the door; and a receiving member that is separately mounted on the mounting part, wherein any one of the receiving member or the mounting part is provided with guide protrusions and the other of the receiving member or the mounting part is formed with a guide groove that guides the movement of the guide protrusions, the receiving member or the mounting part, in which the guide protrusions are formed, is formed with fixing protrusions, and the receiving member or the mounting part, in which the guide groove is formed, is formed with a plurality of fixing grooves in which the fixing protrusions are selectively positioned.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, embodiments will be described in detail with reference to the accompanying drawings.

It is to be noted that the embodiments describe a side-by-side refrigerator as an example for convenience of understanding and explanation and can be applied to all types of refrigerators where a receiving member is provided in a refrigerator door.

Figure 1:
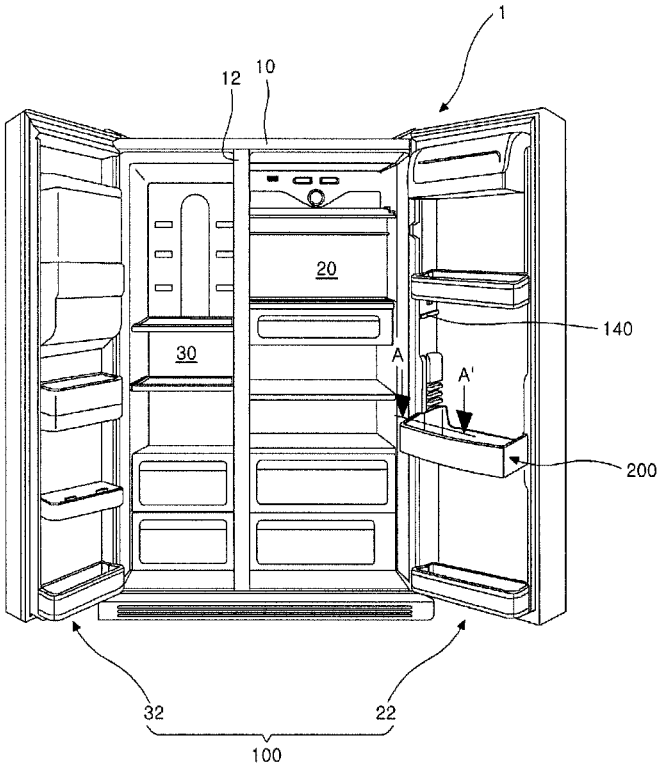
FIG. 1 is a perspective view of a refrigerator whose door according to a first embodiment is opened.

FIG. 1 is a perspective view of a refrigerator whose door according to a first embodiment is opened.

Referring to FIG. 1, a refrigerator 1 according to the first embodiment includes a cabinet 10 that has a storage chamber included therein and a door 100 that opens and closes the storage chamber.

The storage chamber inside the cabinet is partitioned left and right by a barrier 12. A freezing chamber 30 is provided at a left side of the barrier 12 and a refrigerating chamber 20 is provided at a right side of the barrier 12.

The door 100 includes a refrigerating chamber door 22 that opens and closes the refrigerating chamber 20 and a freezing chamber door 32 that opens and closes the freezing chamber 30.

The refrigerating chamber door 22 and the freezing chamber door 32 are rotatably connected to the cabinet 10 by a hinge.

The storage chamber or the door 100 is provided with one or more receiving member 200 for receiving foods.

The up and down position of one or more receiving member 200 can be adjusted in a state where the receiving member 200 is mounted to a rear surface of the door.

In the description of the embodiment, the state where the receiving member 200 is mounted to the door 100 means a state where the receiving member 200 is not completely separated from the door 100.

The state where the receiving member 200 is not completely separated from the door 100 means a state where the position of the receiving member 200 is fixed or a state where the position of the receiving member 200 can be changed at the door.

The receiving member 200 may have various structures that can receive foods and can be mounted in the door 100. Hereinafter, a case where the receiving member 200 is formed in a shape where the upper surface of the receiving member 200 is opened will be described by way of example.

Figure 2:
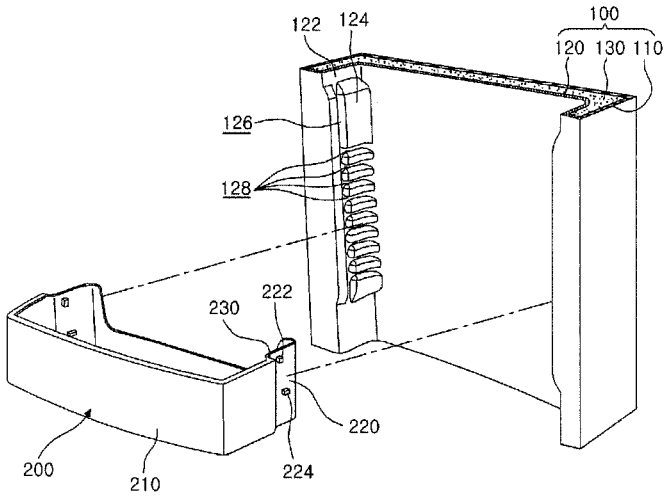
FIG. 2 is a perspective view showing a state where a receiving member according to the first embodiment is separated from the door.
Figure 3:
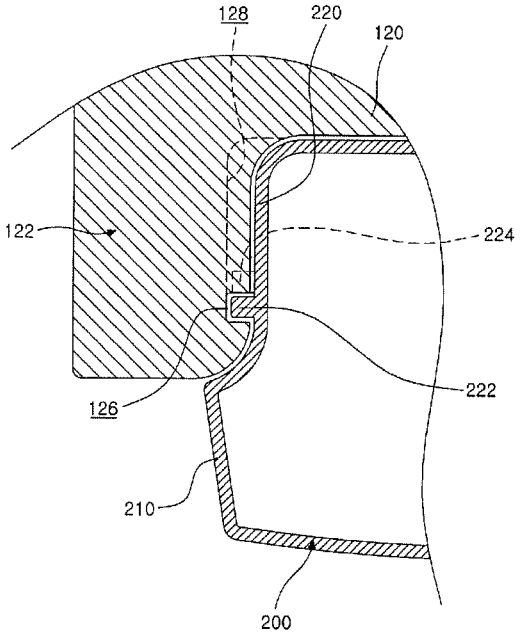
FIG. 3 is a cross-sectional view taken along line A-A' of FIG. 1.

FIG. 2 is a perspective view showing a state where the receiving member according to the first embodiment is separated from the door and FIG. 3 is a cross-sectional view taken along line A-A' of FIG. 1.

Referring to FIGS. 2 and 3, the door 100 includes an outer case 110 that forms a front surface and a peripheral surface, a door liner 120 that faces the storage chamber and forms a rear surface of the door 100, and a heat insulating material 130 that is filled between the outer case 110 and the door liner 120.

The outer case 110 can be understood as a portion shown from the outside in a state where the door 100 closes the storage chamber and the door liner 120 can be understood as a portion, which is not exposed to the outside, in the state where the door 100 closes the storage chamber.

The door liner 120 may be made of a plastic material as one example and the rear surface of the door liner 120 is mounted with one or more receiving member 200.

In the embodiment, the rear surface of the door liner 120 may mean an opposite surface of a surface facing the outer case 110 from the door liner 120.

The door liner 120 is formed with a plurality of door edges 122 that are extended in a front and rear direction in the state where the door 100 closes the storage chamber. The plurality of door edges 122 are spaced from each other, such that the receiving member 200 can be positioned between the plurality of door edges 122.

Each of the door edge 122 includes a mounting part 124. The position of the receiving member 200 can be adjusted in the state where the receiving member 200 is mounted to the mounting part 124. The mounting part 124 is protruded in a direction where each of the door edges 122 approaches each other.

The mounting part 124 is formed with a guide groove 126 that guides the up and down movement of the receiving member 200 and a fixing groove 128 that fixes (or maintains) the position of the receiving member 200 in the state where the receiving member 200 is moved.

One or more guide groove 126 may be formed and at least two fixing grooves 128 can be formed.

In detail, the guide groove 126 is formed the up and down direction of the mounting part 124. The up and down length of the guide groove 126 may be the same as the up and down length of the mounting part 124.

The plurality of fixing grooves 128 are formed in the front and rear direction of the mounting part 124 in the state where the door 100 closes the storage chamber. The plurality of fixing grooves are disposed to be spaced from each other in the up and down direction and are extended from the guide groove 126.

The plurality of fixing grooves 128 are substantially intersected with the guide groove 126.

The embodiment describes the case where the guide groove 126 and the plurality of fixing grooves 128 are formed in the mounting part 124. In contrast, two mounting parts (a first mounting part and a second mounting part) are disposed to be spaced in the front and rear direction of the door, such that the guide groove can be defined. The inwardly positioned mounting part of two mounting parts may be formed with the plurality of fixing grooves 128.

Meanwhile, the receiving member 200 may be formed so that a horizontal direction of the receiving member 200 corresponds to a distance between the plurality of door edges 122 to be able to be disposed between the plurality of door edges 122.

When the receiving member 200 is mounted to the door 100, the receiving member may include a front side portion 210 protruded to the front (when being viewed from FIG. 2) of the door edge 122 and a rear surface portion 220 mounted to the mounting part.

A horizontal direction width of the front side portion 210 is formed to be larger than a horizontal direction width of the rear surface portion 220, such that the left and right sides of the receiving member 200, at which the front side portion 210 contacts the rear surface portion 220, may be formed with a seating part 230 that is formed to have a step.

The seating part 230 may be selectively attached to the mounting part 124 that is formed at the door edge 122.

Both sides of the rear surface portion 220 are each formed with guide protrusions 222 into which the guide grooves 126 are inserted (or received) and fixing protrusions 224 that are inserted (received) into any one of the plurality of fixing grooves 128.

In the embodiment, the guide groove 126 and the guide protrusion 222 may be referred to as a guide unit and the fixing groove 128 and the fixing protrusion 224 may be referred to as a fixing unit.

At this time, heights of inlet sides (sides adjacent to the guide groove 126) of each fixing groove 128 may be formed to be larger than those of other portions so that the fixing protrusions 224 are easily inserted.

In addition, the heights of the inlet sides of each fixing groove 128 may be formed to be larger than those of the fixing protrusions 224.

The guide protrusion 222 is positioned the upper side of the fixing protrusion 224. The width (front and rear length) of the guide protrusion 222 is formed to be smaller than the width (front and rear length) of the guide groove so that the guide protrusion 222 can be smoothly moved on the guide groove 126.

In addition, the guide protrusion 222 is formed in a parallelepiped shape or a regular hexagonal shape and each corner thereof may be rounded or formed in a cylindrical shape.

The fixing protrusion 224 is spaced in a front and rear direction with respect to the guide protrusion 222. The fixing protrusion 224 is positioned to be close to an end portion of the rear surface portion as compared to the guide protrusion.

Therefore, the fixing protrusion 224 is positioned at the guide groove 126 in the state where the position of the receiving member 200 is fixed.

On the other hand, in order to vary the position of the receiving member 200, when the receiving member 200 is tilted upward, considering the guide protrusion 222 as a rotation center, the fixing protrusion 224 is separated from the fixing groove 128 such that it is positioned on the guide groove 126.

When the fixing protrusion is positioned at the guide groove 126, the receiving member can be moved up and down.

The fixing protrusion 224 is formed to have a width smaller than a width of the guide groove 126. Therefore, the fixing protrusion 224 and the guide groove 222 may be positioned at the guide groove 126.

The guide protrusion 224 is formed in a parallelepiped shape or a regular hexagonal shape and each corner thereof may be rounded or formed in a cylindrical shape.

Hereinafter, a process of mounting the receiving member and controlling the height of the receiving member having the above configuration will be described.

Figure 4:
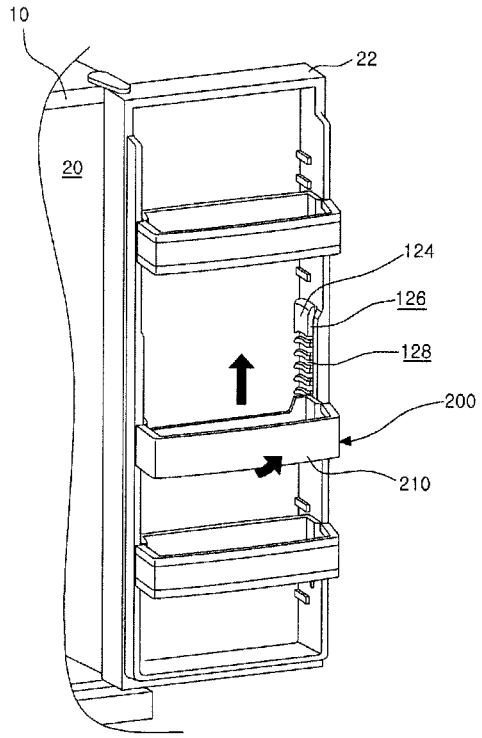
FIG. 4 is a partial perspective view of the door in which the receiving member according to the first embodiment is mounted.
Figure 5:
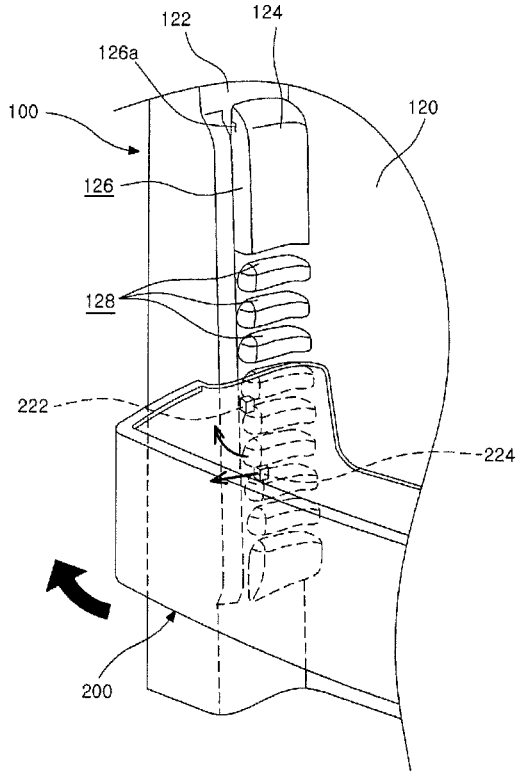
FIG. 5 to 7 are partial perspective views showing an up and down movement state of the receiving member according to the first embodiment.
Figure 6:
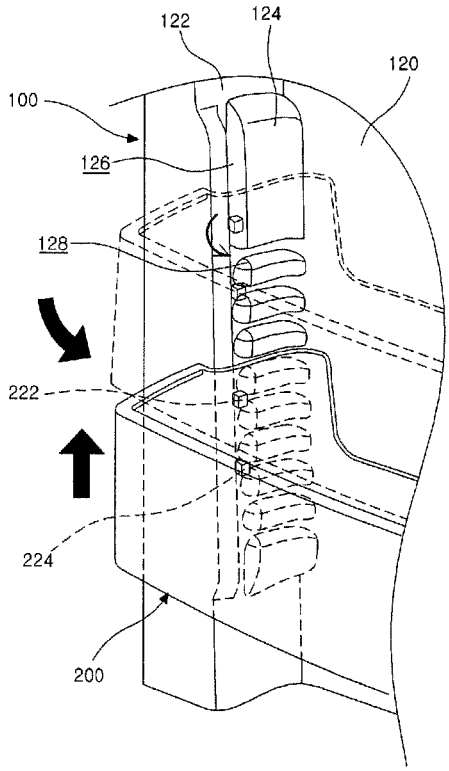
Figure 7:
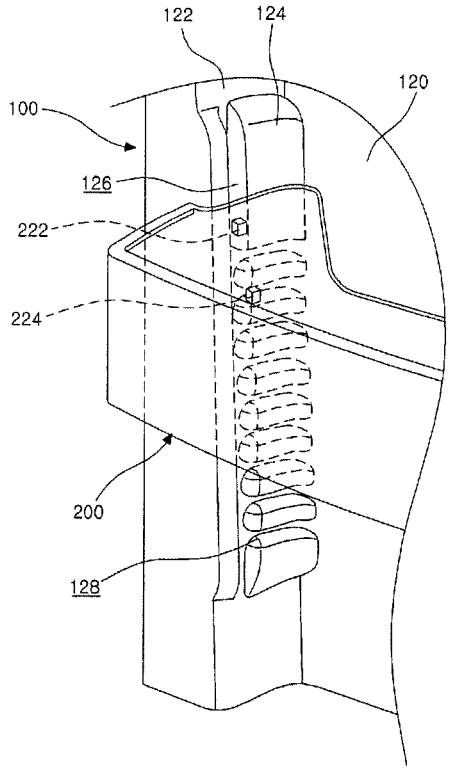

FIG. 4 is a partial perspective view of the door in which the receiving member according to the first embodiment is mounted and FIGS. 5 to 7 are partial perspective views showing the up and down movement state of the receiving member according to the first embodiment.

Referring to FIG. 4 to 7, the fixing protrusion 224 of the receiving member 200 is inserted through the upper side inlet of the guide groove 126 in order to mount the receiving member 200 in the door 100.

The fixing protrusion 224 is inserted, the receiving member 200 is continuously moved downward, the receiving member 200 is rotated clockwise based on FIG. 5, and the guide protrusion 222 is then inserted into the guide groove 126.

At this time, the fixing protrusion 224 and the guide protrusion 222 are positioned at the same extending line in the state where they are received in the inner side of the guide groove 126 and the receiving member 200 is tilted by a predetermined angle clockwise based on the fixing protrusion 224.

The user can move the receiving member 200 up and down in the state where the fixing protrusion 224 and the guide protrusion 222 are inserted.

When the receiving member 200 is positioned at a desired position, the receiving member 200 is rotated counterclockwise based on FIG. 5, considering the guide protrusion 222 as a rotation center.

Since the guide protrusion 222 plays a role of a rotational shaft when the receiving member 200 is rotated, the position of the guide protrusion is fixed, while the fixing protrusion 224 is inserted into the fixing groove 128 from the guide groove 126.

At this time, when the fixing protrusion 224 and the specific fixing groove 128 are not completely aligned, the user can move the receiving member 200 up and down in order to insert the fixing protrusion 224 into the specific fixing groove 128.

Since the outer side of the fixing protrusion 224 is rounded and the height of the inlet side of the fixing groove 128 is larger than that of the fixing protrusion 224, the fixing protrusion 224 can be easily inserted into the fixing groove 128.

When the position fixing of the receiving member 200 completes, it becomes a state as shown in FIG. 5. In detail, in the state where the position fixing of the receiving member 200 completes, the guide protrusion 222 is positioned on the guide groove 126 to limit the front and rear movement of the receiving member 200. The fixing protrusion 224 limits the up and down movement of the receiving member 200.

The rear surface of the rear surface portion 220 of the receiving member 200 continuously contacts the door liner 120.

In such a state, when the receiving member 200 moves to the upper side or the lower side, the receiving member 200 is rotated clockwise, considering the guide protrusion 222 as the rotation shaft.

The fixing protrusion 224 is separated from the fixing groove 128 to the guide groove 126 by the rotation of the receiving member 200. Therefore, the guide protrusion 222 and the fixing protrusion 224 are positioned on the same extending line and positioned in the inner side of the guide groove 126, such that they can be moved up and down as shown in FIG. 6.

In such a state, the user can move the receiving member 200 to a desired position. For example, in order for the user to move the receiving member 200 upward, the receiving member 200 is lifted upward to the desired position in the state where the receiving member 200 is tilted, that is, the fixing protrusion 224 and the guide protrusion 222 are positioned at the guide groove 126.

When the receiving member 200 reaches the desired position, the user again rotates the receiving member 200 counterclockwise. When the receiving member 200 is rotated counterclockwise, considering the guide protrusion 220 as the rotation center, the fixing protrusion 224 is inserted into the inner side of the fixing groove 128 from the guide groove 126.

In the first embodiment, the mounting part 124 of the door liner 120 is formed with the guide groove 126 and the plurality of fixing grooves 128 and the guide protrusion 222 and the fixing protrusion 224 are formed in the receiving member 200. To the contrary, the guide protrusion 222 and the fixing protrusion are formed on the mounting part 124 and the guide groove and the plurality of fixing grooves may be formed in the receiving member 200.

Meanwhile, various embodiments can be made in addition to the above-mentioned embodiment, and therefore, the description thereof will be described in detail below.

Figure 8:
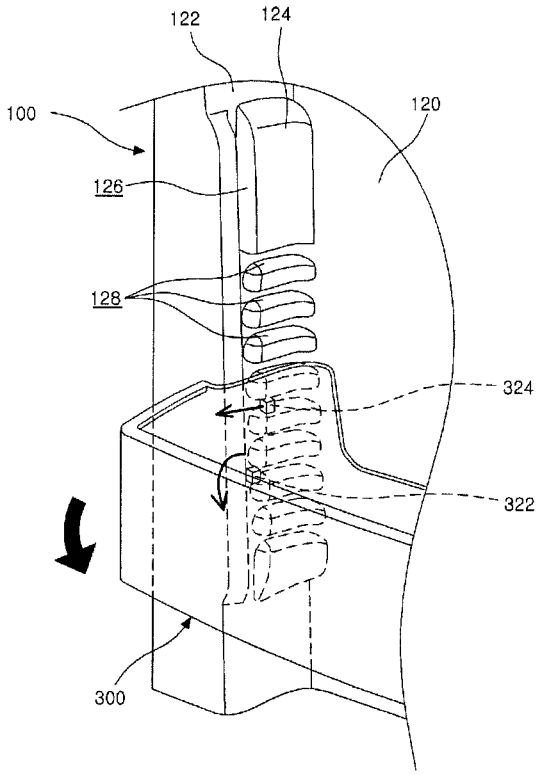
FIG. 8 is a partial perspective view of a door in which a receiving member according to a second embodiment is mounted.

FIG. 8 is a partial perspective view of a door in which a receiving member according to a second embodiment is mounted.

A second embodiment is the same as the fist embodiment, except that a fixing protrusion of a receiving member is positioned at an upper side of a guide protrusion.

In describing the third embodiment, the same components as the first embodiment are denoted by the same reference numerals and therefore, the description thereof will be omitted.

Referring to FIG. 8, left and right sides of a receiving member 300 according to the second embodiment may be formed with a guide protrusion 322 and a fixing protrusion 324 that are received in the guide groove 126 and the fixing groove 128, respectively. The guide protrusion 322 is positioned the lower side of the fixing protrusion 324.

Therefore, when the receiving member 300 is rotated counterclockwise based on FIG. 8, considering the guide protrusion 322 as a shaft, the fixing protrusion 324 is positioned at the guide groove 126, such that the receiving member 300 can be moved up and down.

When the receiving member 300 is rotated clockwise considering the guide protrusion as the rotation center in the state where the guide protrusion 322 and the fixing protrusion 324 are positioned at the guide groove 126, the fixing protrusion 324 is inserted into the inner side of the fixing groove 128, such that the position of the receiving member 300 can be fixed.

Figure 9:
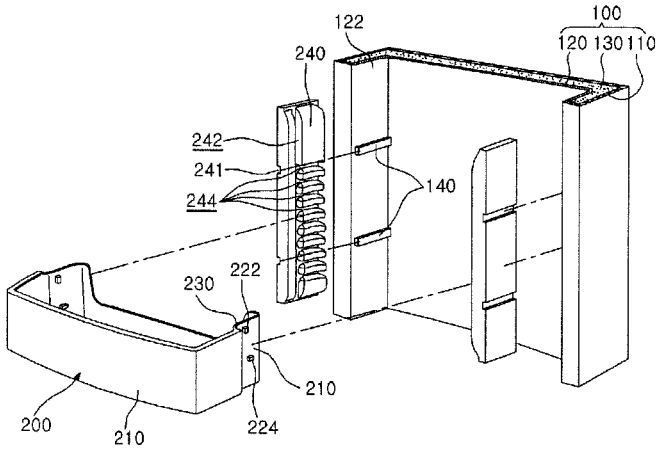
FIG. 9 is an exploded perspective view of a door according to a third embodiment.

FIG. 9 is an exploded perspective view of a door according to a third embodiment.

A third embodiment is the same as the first embodiment, except that a separate mounting part, on which a guide groove and a fixing groove are formed, is connected to a door liner.

In describing the third embodiment, the same components as the first embodiment are denoted by the same reference numerals and therefore, the description thereof will be omitted.

Referring to FIG. 9, the door liner 120 according to the third embodiment is formed with the plurality of door edges 122. Each of the door edges 122 is connected to a mounting part 240 on which the receiving member 200 is mounted.

Each of the door edges 122 is formed with a first connection part 140 to which the mounting part 240 is connected and the mounting part 240 is formed with a second connection part 241 to which the first connection part 140 is connected. As one example, in the third embodiment, the first connection part 140 can be inserted into the second connection part 241 by a sliding manner and in the present embodiment, it is to be noted that the connection structure of the mounting part and the door edge is not limited.

The mounting part 240 may be made of the same material as the door liner 120 or different materials from the door liner 120 and is formed with a guide groove 242 and a plurality of fixing grooves 244.

With the embodiments, since the mounting part 240 and the receiving member 200 are provided as a separate article and may be mounted in the door, it can determined whether the receiving member 200 is mounted without changing the entire design of the refrigerator door 100 in accordance with the model of the refrigerator.

With the proposed embodiments, the receiving member can be moved up and down (height control) in the state where the receiving member is not separated from the door, thereby increasing the convenience of the user.

In addition, the receiving member is in the movable state by the tilting (rotating) operation in the state where it is mounted on the mounting part and after the movement of the receiving member is completed, it is tilted (rotated) counterclockwise and the position of the receiving member is thus fixed, thereby improving the operation convenience of the user.

Further, when the mounting part is formed as a separate article and is connected to the door, the receiving member can be moved up and down while minimizing the change in the door structure.

What is claimed is:

1. A refrigerator, comprising:

a cabinet that defines a storage chamber;

a door that is connected to the cabinet and opens and closes the storage chamber;

a mounting part provided at the door;

a receiving member that is mounted to the door and that is configured to receive one or more food items;

a guide groove that is located on the mounting part and that extends in a vertical direction;

fixing grooves that extend from the guide groove in a horizontal direction;

a guide protrusion provided on the receiving member and positioned in the guide groove; and a fixing protrusion spaced apart from the guide protrusion and selectively positioned in one of the fixing grooves, wherein when the fixing protrusion is positioned at one of the fixing grooves, the position of the receiving member is fixed, and when the fixing protrusion is moved from the one of the fixing grooves to the guide groove, the fixing of the receiving member is released.

2. The refrigerator according to claim 1, wherein in the state where the receiving member can be moved up and down by the guide groove and the guide protrusion, the position of the receiving member is fixed by a tilting operation of the receiving member.

3. The refrigerator according to claim 1, wherein in the state where the position of the receiving member is fixed by the fixing protrusion and one of the fixing grooves, the fixing of the receiving member is released by a tilting operation of the receiving member.

4. The refrigerator according to claim 1, wherein the receiving member is mounted or separated to or from the door in a parallel direction with an extending direction of the guide groove.

5. The refrigerator according to claim 1, wherein the mounting part is separately connected to the door, and the door is formed with a first connection part and the mounting part is formed with a second connection part that is connected to the first connection part.

6. The refrigerator according to claim 1, wherein a height of an inlet side of each of the fixing grooves is larger than that of the fixing protrusion.

7. The refrigerator according to claim 1, wherein the fixing protrusion and the guide protrusion are spaced in an up and down direction of the receiving member.

8. The refrigerator according to claim 1, wherein the guide groove restricts separation of the receiving member from the door and guides movement of the receiving member between higher and lower positions by movement of the guide protrusion along the guide groove.

9. The refrigerator according to claim 1:

wherein the door comprises a door liner that defines a plurality of door edges that are spaced from each other;

wherein the receiving member is positioned between the plurality of door edges; and wherein the mounting part is positioned on one of the plurality of door edges.

10. The refrigerator according to claim 9, wherein the mounting part protrudes in a direction where each of the door edges approaches each other.

11. The refrigerator according to claim 1, wherein a horizontal width of a front side portion of the receiving member is larger than a horizontal width of a rear surface portion of the receiving member such that left and right sides of the receiving member, at which the front side portion contacts the rear surface portion, define a seating part that has a step.

12. The refrigerator according to claim 11, wherein the seating part selectively attaches to the mounting part and the guide protrusion and the fixing protrusion are located on a side of the rear surface portion of the receiving member.

13. The refrigerator according to claim 1, wherein, when the receiving member is mounted to the mounting part, the guide protrusion is positioned above the fixing protrusion.

14. The refrigerator according to claim 1, wherein the fixing protrusion is positioned to be closer to an end portion of a rear surface portion of the receiving member than the guide protrusion.

15. The refrigerator according to claim 1, wherein, to reposition the receiving member from a first height defined by a first of the fixing grooves to a second height defined by a second of the fixing grooves, the fixing protrusion is released from the first of the fixing grooves and moved to the guide groove, the receiving member is moved from the first height to the second height with both the guide protrusion and the fixing protrusion positioned in the guide groove, and the fixing protrusion is inserted into the second of the fixing grooves to secure the receiving member at the second height.

16. The refrigerator according to claim 1, wherein, to reposition the receiving member from a first height defined by a first of the fixing grooves to a second height defined by a second of the fixing grooves, the receiving member is rotated in a first direction with the guide protrusion being a center of rotation until the fixing protrusion is released from the first ofthe fixing grooves and moved to the guide groove, the receiving member is moved from the first height to the second height with both the guide protrusion and the fixing protrusion positioned in the guide groove, and the receiving member is rotated in a second direction with the guide protrusion being the center of rotation until the fixing protrusion is inserted into the second of the fixing grooves and secured at the second height, the second direction being opposite of the first direction.

17. The refrigerator according to claim 1, wherein the guide protrusion has a parallelepiped shape with each corner being rounded and the fixing protrusion has the parallelepiped shape with each corner being rounded.

18. The refrigerator according to claim 1, wherein the guide protrusion has a hexagonal shape with each corner being rounded and the fixing protrusion has the hexagonal shape with each corner being rounded.

19. A refrigerator, comprising:

a cabinet that defines a storage chamber;

a door that is connected to the cabinet and opens and closes the storage chamber;

a mounting part provided at the door;

a receiving member that is mounted to the door and that is configured to receive one or more food items;

a guide groove that is located on the mounting part and that extends in a vertical direction;

fixing grooves that extend from the guide groove in a horizontal direction;

a guide protrusion provided on the receiving member and positioned in the guide groove; and a fixing protrusion spaced apart from the guide protrusion and selectively positioned in one of the fixing grooves, wherein a height of an inlet side of each of the fixing grooves is larger than a height of other portions of each of the fixing grooves, the inlet side being adjacent to the guide groove.

* * * * *